US005511389A

United States Patent [19]

Bush et al.

[11] Patent Number: 5,511,389

[45] Date of Patent: Apr. 30, 1996

[54] ROTARY COMPRESSOR WITH LIQUID INJECTION

[75] Inventors: James W. Bush, Skaneateles; Alexander D. Leyderman; Donald Yannnascoli, both of Manlius, all of N.Y.

[73] Assignee: Carrier Corporation, Syracuse, N.Y.

[21] Appl. No.: 197,418

[22] Filed: Feb. 16, 1994

[51] Int. Cl.[6] ..... F25B 31/00

[52] U.S. Cl. ..... 62/505; 417/97

[58] Field of Search ..... 62/505; 417/97, 417/63

[56] References Cited

U.S. PATENT DOCUMENTS 4,995,792 2/1991 Brown et al. ..... 62/505 X

FOREIGN PATENT DOCUMENTS 0065994 4/1983 Japan ..... 418/97

0148295 9/1983 Japan ..... 418/97

0244192 9/1989 Japan ..... 418/97

*Primary Examiner*—William E. Wayner

[57] ABSTRACT

In a high side rotary compressor, liquid refrigerant is supplied to is to the compression chamber via a capillary tube and liquid injection port. The lubricant is delivered only after the suction port has closed and before chamber pressure exceeds the liquid injection supply pressure.

6 Claims, 4 Drawing Sheets

ROTARY COMPRESSOR WITH LIQUID INJECTION

BACKGROUND OF THE INVENTION

In a fixed vane or rolling piston compressor, the vane is biased into contact with the cylindrical roller or piston. The roller or piston is carried by an eccentric on the crankshaft and tracks along the inside surface of the cylinder in a line contact such that the piston and cylinder coact to define a crescent shaped space. The space rotates about the axis of the crankshaft and is divided into a suction chamber and a compression chamber by the vane coacting with the piston. In rolling piston compressors used in hermetic refrigerant systems, it is common practice to use discharge gas from the compressor to absorb the waste heat of the motor and keep it acceptably cool. In refrigeration applications or when the input power is greater than about two horsepower, heat generated by the motor cannot be absorbed by the discharge gas without significantly increasing the temperature of the gas and the windings.

SUMMARY OF THE INVENTION

In a high side rolling piston compressor the interior of the shell is at discharge pressure. Between the beginning of the compression stroke and the beginning of the discharge stroke, the trapped volume defined by the cylinder, piston and vane goes from suction pressure to discharge pressure. Injection of liquid refrigerant into the trapped volume has several consequences. Within the trapped volume there is an increase in mass to be compressed and a decrease in temperature due to the evaporation of the liquid refrigerant. The decrease in temperature is carried over by the discharge gas thereby helping to cool the motor windings. Because an increased mass is being compressed, there can be a decrease in capacity depending upon the specifics of the system. Factors influencing the capacity include the source and amount of liquid injection, whether reverse flow takes place in the injection port, and what the steady state condition is as well as system load and ambient temperature. To maintain a constant capacity of the compressor, the piston coacts with the opening to uncover a restricted opening and thereby permit liquid refrigerant injection during a portion of the compression stroke but otherwise blocking flow. Injection takes place after the suction port is isolated from the trapped volume but it is important to prevent backflow in the liquid injection line. As the pressure of the trapped volume increases, it may exceed the pressure in the liquid injection port because of pressure losses in the discharge valve, condenser, and liquid line. Ideally the liquid injection port should be closed when the pressure in a trapped volume reaches the value of the injection port pressure. This point varies with operating condition and the flow resistance of the injection port mitigates any tendency for backflow.

The mass flow through the evaporator determines the refrigeration capacity of the system and is limited by the flow from the evaporator into the suction of the compressor. So, the liquid injection represents refrigerant compressed by the compressor but not passing through the evaporator and has no influence on the cooling capacity of the refrigeration system. The foregoing assumes that the liquid injection does not affect the compressor capacity and takes place with refrigerant excess to the cooling requirement of the system and intended to be used for motor cooling.

It is an object of this invention to provide motor cooling through liquid injection without changing the compressor or evaporator capacity.

It is another object of this invention to optimize the location of the liquid injection port. These objects, and others as will become apparent hereinafter, are accomplished by the present invention.

Basically, liquid refrigerant from a point downstream of the condenser is supplied via a capillary and injected into the trapped volume only during the time when the trapped volume is at a lower pressure than the liquid refrigerant with fluid communication otherwise blocked.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
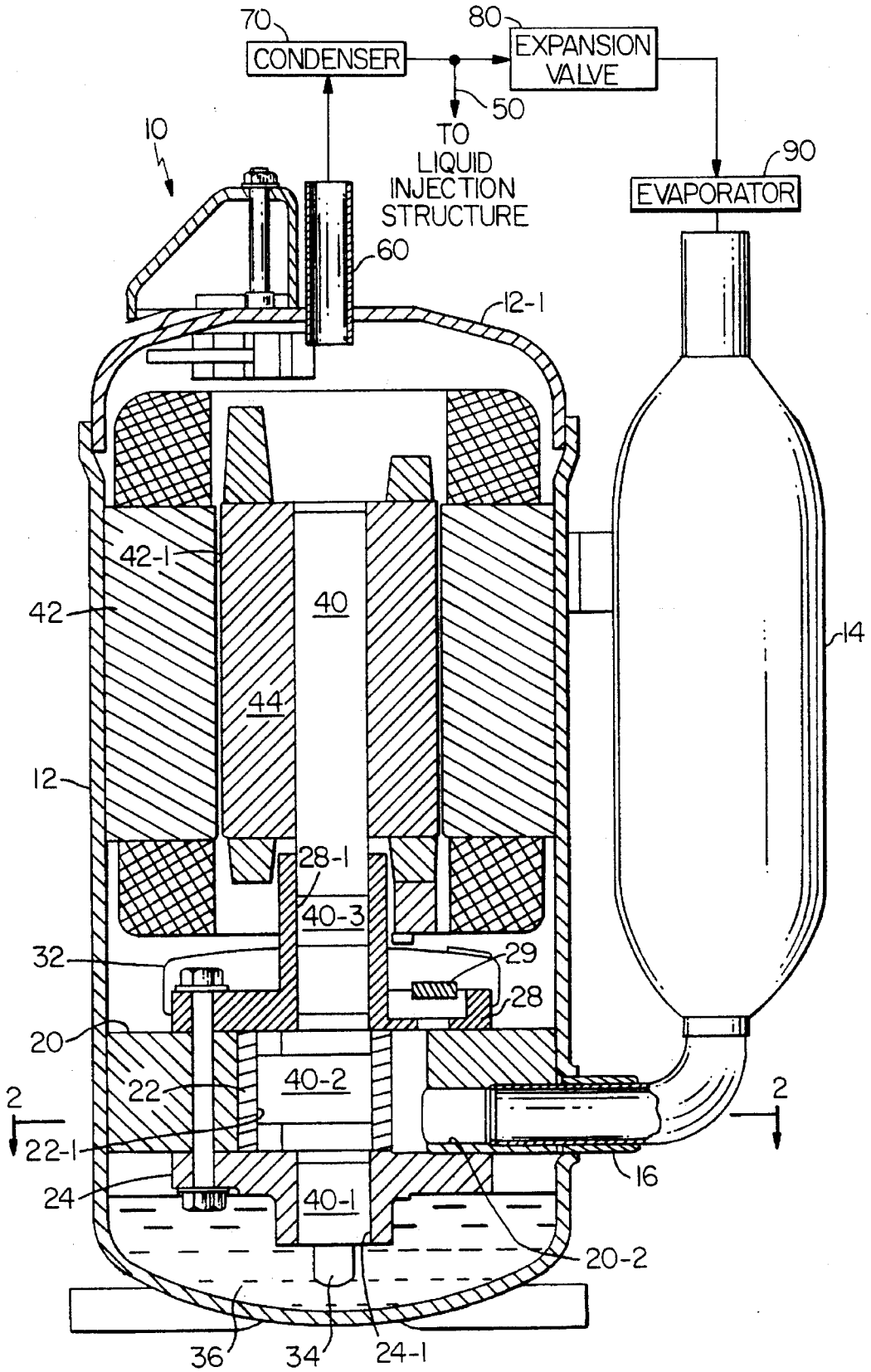
FIG. 1 is a partially sectioned view of a compressor employing the present invention schematically located in a refrigeration circuit.
Figure 2:
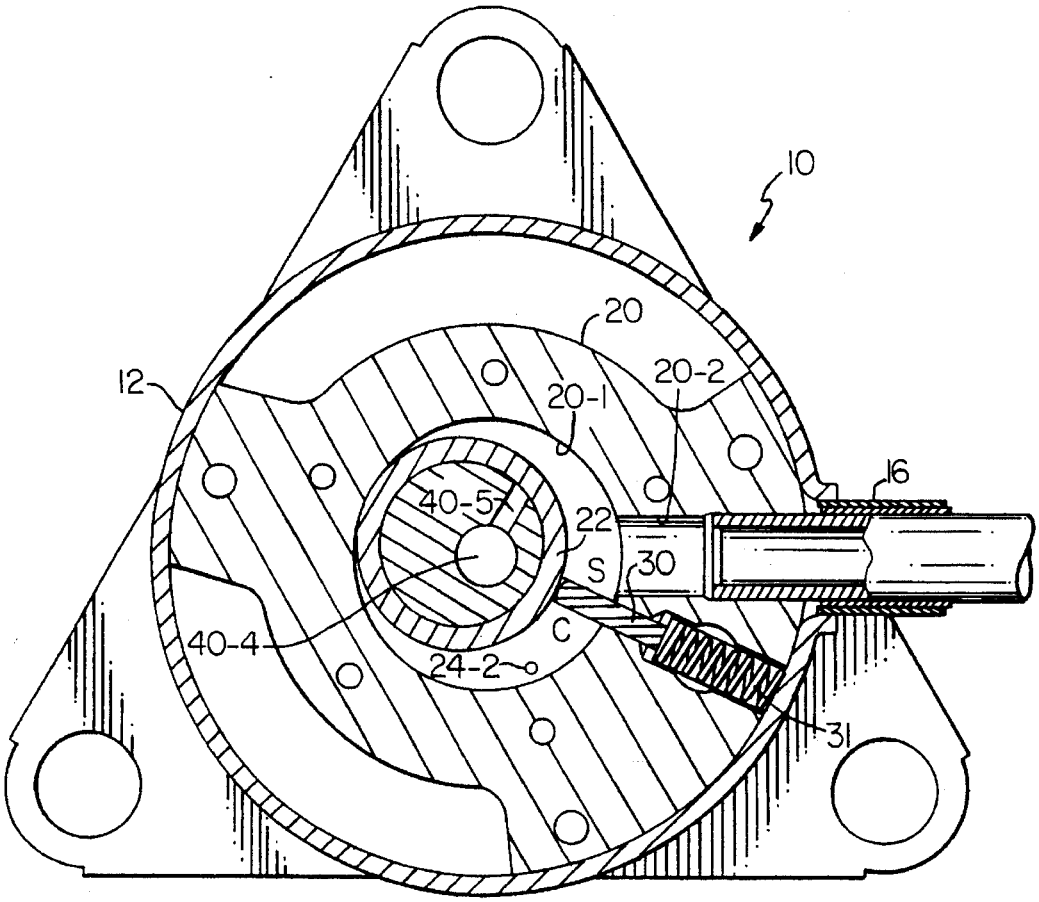
FIG. 2 is a sectional view taken along line 2—2 of FIG. 1.

In FIGS. 1 and 2, the numeral 10 generally designates a vertical, high side rolling piston compressor. Compressor 10 is in a refrigeration circuit serially including compressor 10, condenser 70, expansion valve 80 and evaporator 90. The numeral 12 generally designates the shell or casing. Suction tube 16 is sealed to shell 12 and provides fluid communication between suction accumulator 14, which is connected to evaporator 90, and suction chamber S. Suction chamber S is defined by bore 20-1 in cylinder 20, piston 22, pump end bearing 24 and motor end bearing 28.

Eccentric shaft 40 includes a portion 40-1 supportingly received in bore 24-1 of pump end bearing 24, eccentric 40-2 which is received in bore 22-1 of piston 22, and portion 40-3 supportingly received in bore 28-1 of motor end bearing 28. Oil pick up tube 34 extends into sump 36 from a bore in portion 40-1. Stator 42 is secured to shell 12 by shrink fit, welding or any other suitable means. Rotor 44 is suitably secured to shaft 40, as by a shrink fit, and is located within bore 42-1 of stator 42 and coacts therewith to define a variable speed motor. Vane 30 is biased into contact with piston 22 by spring 31. As described so far, compressor 10 is generally conventional.

Figure 3:
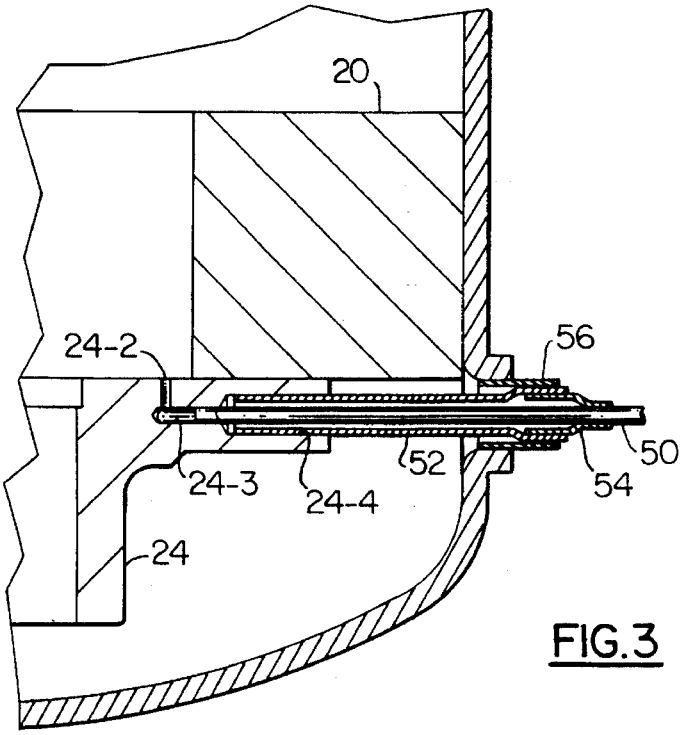
FIG. 3 is an enlarged view of the liquid injection structure.

The present invention adds machined liquid refrigerant injection port 24-2 which is preferably 0.5 to 1.3 mm in diameter. As best shown in FIG. 3, injection port 24-2 is connected to capillary tube 50 which is received in bore 24-3. Connecting tube 52 is located within bore 24-4 and surrounds, supports and seals capillary tube 50 from the interior of shell 12. Connecting tube 52 extends through shell 12 and is sealed to capillary tube 50 via seal 54 and is sealed to shell 12 via tube 56. As will be explained in greater detail below, the liquid injection port 24-2 is located such that piston 22 coacts therewith to open and close the injection port 24-2 during the compression cycle.

In operation, rotor 44 and eccentric shaft 40 rotate as a unit and eccentric 40-2 causes movement of piston 22. Oil from sump 36 is drawn through oil pick up tube 34 into bore 40-4 which acts as a centrifugal pump. The pumping action will be dependent upon the rotational speed of shaft 40. As best shown in FIG. 2, oil delivered to bore 40-4 is able to flow into a series of radially extending passages, in portion 40-1, eccentric 40-2 and portion 40-3 exemplified by passage 40-5 in eccentric 40-2, to lubricate bearing 24, piston 22, and bearing 28, respectively. The excess oil flows from bore 40-4 and either passes downwardly over the rotor 44 and stator 42 to the sump 36 or is carried by the gas flowing from annular gap between rotor 44 and stator 42 and impinges and collects on the inside of cover 12-1 before draining to sump 36. Piston 22 coacts with vane 30 in a conventional manner such that gas is drawn through suction tube 16 and passageway 20-2 to suction chamber S. The gas in suction chamber S is compressed and discharged via discharge valve 29 into the interior of muffler 32. The compressed gas passes through muffler 32 into the interior of shell 12 and passes via the annular gap between rotating rotor 44 and stator 42 and through discharge line 60 to the condenser 70 of the refrigeration circuit.

Figure 4A:
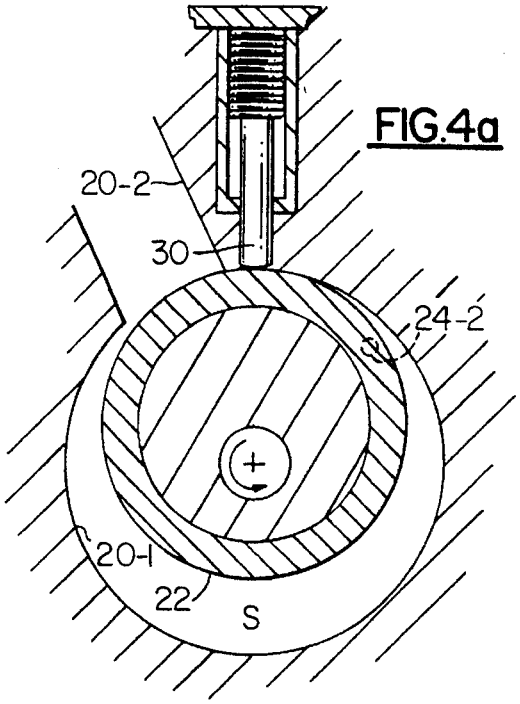
FIGS. 4A–D show the coaction of the piston with the liquid injection structure at 90° intervals.
Figure 4B:
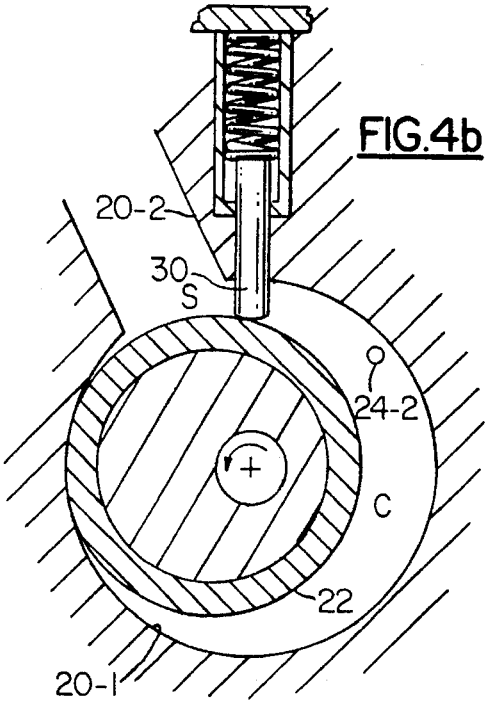
Figure 4D:
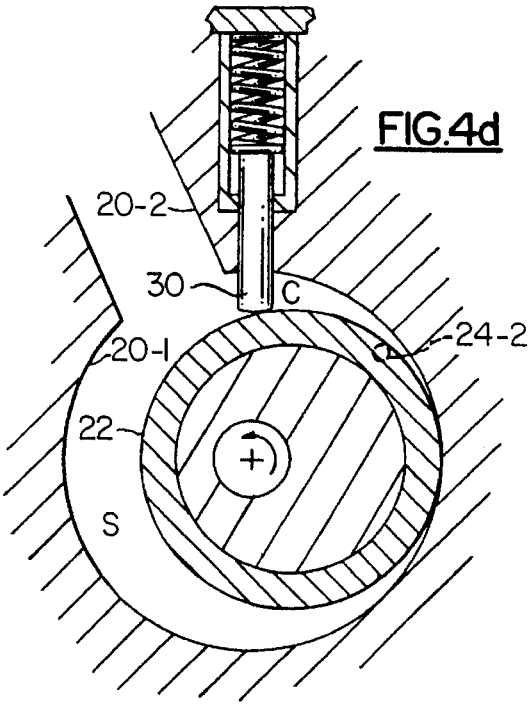
Figure 4C:
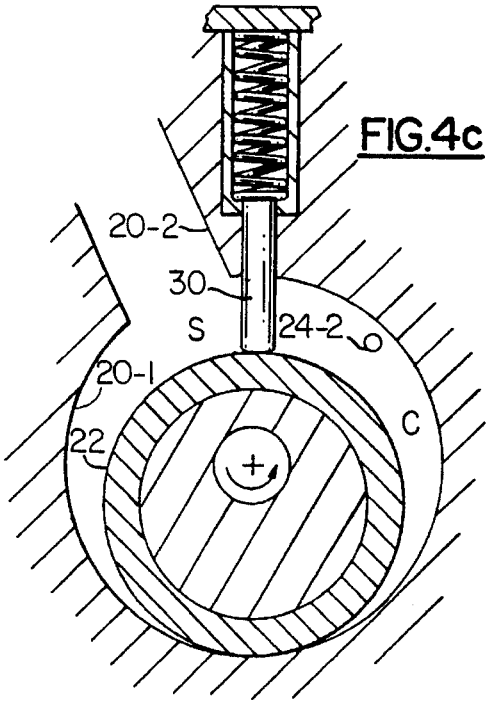

Referring now to FIG. 4A, it will be noted that suction chamber S makes up the entire crescent shaped space between piston 22 and bore 20-1 and marks the end of both the suction and the compression processes. In FIG. 4B, which is displaced 90° from FIG. 4A, the suction chamber of FIG. 4A has been cut off from suction tube 16 and has been transformed into a compression chamber C while a new suction chamber is being formed. FIG. 4C corresponds to FIGS. 1 and 2 and represents an intermediate point in the compression process. FIG. 4D represents the later part of the suction and discharge processes which are each nominally completed in FIG. 4A.

At the beginning of each compression cycle which is best shown in FIG. 4B, the pressure in compression chamber C is less than the condenser pressure. As a result, liquid refrigerant at condenser pressure is forced into compression chamber C via capillary tube 50 bore 24-3 and liquid injection port 24-2, if port 24-2 is uncovered. The liquid refrigerant injected into the compression chamber via port 24-2 evaporates, cooling and increasing the mass of the refrigerant in compression chambers C, and disperses. In comparing FIGS. 4A and 4B it is clear that liquid injection port 24-2 is only opened after suction inlet is sealed off so that the full volume of refrigerant is present. Similarly, comparing FIGS. 4C and 4D, before the pressure in the compression chamber C reaches injection pressure, piston 22 closes the liquid injection port 24-2 and thereby prevents back flow.

Figure 5:
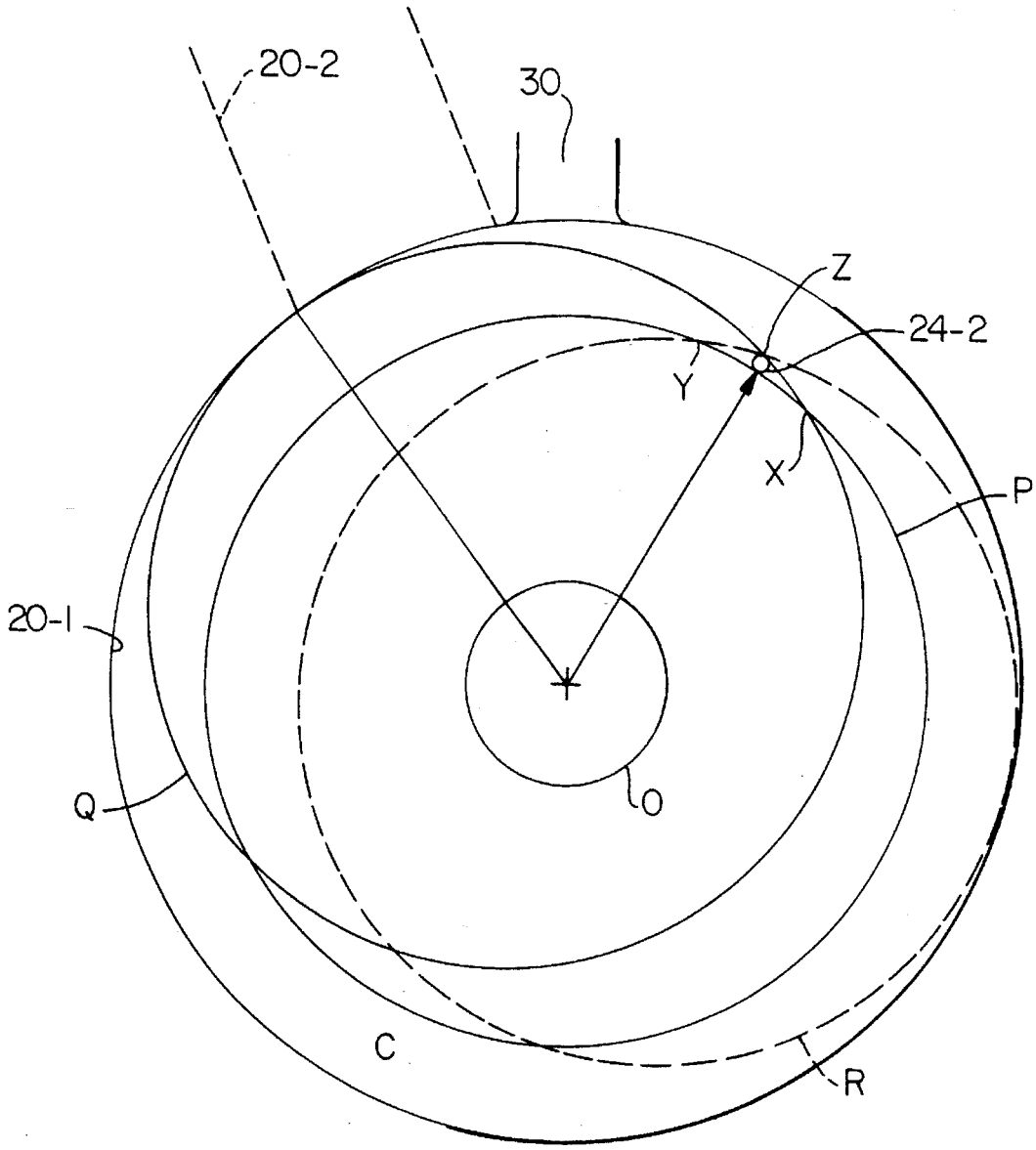
FIG. 5 is a diagram showing the optimum location of the liquid injection port.

The specific location and size of liquid injection port 24-2 is very important. Specifically, it can control how much of the available time the injection takes place over, the range of pressure differentials over which injection takes place, and the amount of refrigerant injected. Ideally, the amount of refrigerant injected is only sufficient to provide the necessary degree of cooling. As the components are designed to operate at elevated temperatures, excess cooling gives a net increase in energy consumption due to the lower temperature and increased mass flow of the discharge gas cooling the motor. The location of port 24-2 must be such that it is covered and uncovered by the piston 22 during operation and that it is uncovered only during the compression process. Preferably, the injection takes place over the entire compression process but because of the reducing pressure differential during the compression process the rate of fluid being injected reduces with the advancing of the compression process. As a result the injection flow rate at the completion of compression process will be zero or very small, with perhaps even the tendency for reverse flow. This is qualified by two factors, the size of port 24-2 and the time available for the injection process. Referring now to FIG. 5, O is the path of the center of eccentric 40-2. The area always covered by piston 22 and unavailable for a valving action by piston 22 is designated by circle P. The annular area between circle P and bore 20-1 is available to be valved by piston 22. Circle Q represents the position of piston 22 when compression chamber C is isolated from suction passageway 20-2. Circle R represents the position of piston 22 when the pressure in compression chamber C is equal to the pressure in capillary tube 50. It should be noted that circle R is a design choice since the pressure build up in chamber C is a function of the reduction in the volume of chamber C, the mass flow into the chamber C via tube 50 and the pressure of the refrigerant in bore 24-3 or capillary tube 50. The mass flow into chamber C via tube 50 is, in turn, a function of the size of injection port 24-2 and the duration of fluid communication.

Point X is a point of intersection of circles Q and P. Point Y is a point of intersection of circles P and R. Point Z is a point of intersection between circles Q and R radially outward of circle P. Accordingly, the liquid injection port 24-2 is located within the area bounded by points X, Y, and Z. By placing injection port 24-2 within the area bounded by points X, Y, and Z, the mass flow into the trapped volume can be controlled to correspond to cooling needs since it is related to a point within the compression process and helps control when the discharge pressure is reached in the compression process. The amount of injected refrigerant is therefore controlled and has no effect on the capacity on the refrigeration system since the injection flow can be considered to bypass the evaporator flow and is an additional flow designed to be the motor cooling flow.

Although the present invention has been illustrated and described in terms of a vertical, variable speed compressor, other modifications will occur to those skilled in the art. For example, the invention is applicable to both horizontal and vertical compressors. Similarly the motor need not be a variable speed motor. It is therefore intended that the present invention is to be limited only by the scope of the appended claims.

What is claimed is:

1. In a refrigeration system containing refrigerant and serially including a high side rotary compressor, a condenser, expansion means and an evaporator said compressor comprising:

shell means having a first end and a second end;

cylinder means containing pump means including a vane and a piston coacting with said cylinder means to define suction and compression chambers;

said cylinder means being fixedly located in said shell means near said first end;

first bearing means secured to said cylinder means and extending towards said first end;

second bearing means secured to said cylinder means and extending towards said second end;

motor means including rotor means and stator means;

said stator means fixedly located in said shell means between said cylinder means and said second end and axially spaced from said cylinder means and said second bearing means;

eccentric shaft means supported by said first and second bearing means and including eccentric means operatively connected to said piston;

said rotor means secured to said shaft means so as to be integral therewith and located within said stator so as to define therewith an annular gap;

suction means for supplying gas to said pump means;

discharge means fluidly connected to said pump means via said annular gap and sealed to said shell means;

liquid refrigerant injection port opening into said compression chamber;

restricted delivery means for delivering liquid refrigerant at condenser pressure to said injection port;

said piston coacting with said injection port to permit delivery of liquid refrigerant to said compression chamber for a portion of each compression cycle whereby compressed gas passing from said pump means to said discharge means via said annular gap cools said motor means.

2. The compressor of claim 1 wherein said liquid refrigerant injection port is located in said first bearing means.

3. The compressor of claim 1 wherein said compressor is vertical compressor.

4. The compressor of claim 1 wherein said motor means is a variable speed motor.

5. The compressor of claim 1 wherein said refrigerant injection port is 0.5 to 1.3 mm in diameter.

6. The compressor of claim 1 wherein said liquid refrigerant injection port is located in an area covered and uncovered by said piston during each compression cycle and is uncovered by said piston only when said injection port will be in communication with said compression chamber and when pressure in said compression chamber will not exceed pressure of said liquid refrigerant which is supplied to said injection port.

* * * * *